US006388183B1

(12) United States Patent
Leh

(10) Patent No.: US 6,388,183 B1
(45) Date of Patent: May 14, 2002

(54) VIRTUAL MUSICAL INSTRUMENTS WITH USER SELECTABLE AND CONTROLLABLE MAPPING OF POSITION INPUT TO SOUND OUTPUT

(75) Inventor: Stephen M. Leh, Boston, MA (US)

(73) Assignee: Leh Labs, L.L.C., Everett, MA (US)

( * ) Notice: Subject to any disclaimer, the term of this patent is extended or adjusted under 35 U.S.C. 154(b) by 0 days.

(21) Appl. No.: 09/851,269

(22) Filed: May 7, 2001

(51) Int. Cl.[7] ..... G10H 7/00
(52) U.S. Cl. ..... 84/645; 84/742
(58) Field of Search ..... 84/645, 644, 670, 84/742

(56) References Cited

U.S. PATENT DOCUMENTS

| | | | | | |
|---|---|---|---|---|---|
| 4,829,872 | A | * | 5/1989 | Topic et al. | |
| 4,980,519 | A | | 12/1990 | Mathews | 178/19 |
| 5,005,459 | A | | 4/1991 | Adachi et al. | 84/453 |
| 5,288,938 | A | | 2/1994 | Wheaton | 84/600 |
| 5,355,762 | A | | 10/1994 | Tabata | 84/609 |
| 5,393,926 | A | | 2/1995 | Johnson | 84/610 |
| 5,541,358 | A | | 7/1996 | Wheaton et al. | 86/645 |
| 5,627,335 | A | | 5/1997 | Rigopulos et al. | 84/635 |
| 5,670,729 | A | | 9/1997 | Miller et al. | 84/609 |
| 5,714,698 | A | | 2/1998 | Tokioka et al. | 73/865.4 |
| 5,880,392 | A | * | 3/1999 | Wessel et al. | |
| 5,880,411 | A | * | 3/1999 | Gillespie et al. | |
| 5,890,116 | A | | 3/1999 | Itoh et al. | 704/260 |
| 6,005,181 | A | * | 12/1999 | Adams et al. | |
| 6,018,118 | A | * | 1/2000 | Smith et al. | 84/600 |
| 6,066,794 | A | * | 5/2000 | Longo | 84/645 X |
| 6,150,600 | A | | 11/2000 | Buchla | 84/688 |
| 6,245,982 | B1 | * | 6/2001 | Suzuki et al. | |

* cited by examiner

*Primary Examiner*—Jeffrey Donels
(74) *Attorney, Agent, or Firm*—Kent A. Lembke; Hogan & Hartson LLP

(57) ABSTRACT

A method, and corresponding computer system, for mapping user positional data to output data based on user selection and customization input. The method includes displaying a number of mapping routine identifiers to a user through a user interface. User selection input is received indicating a user selection of one of the mapping routine identifiers and a mapping routine corresponding to the selected identifier is retrieved and executed. User position data is received (e.g., MIDI data from a MIDI hardware controller) and the user position data is processed with the selected mapping routine to map the user position data to output data. The output data is then transmitted via an interface such as a MIDI interface to an output device to create an output (such as a synthesizer connected to speakers).

16 Claims, 3 Drawing Sheets

VIRTUAL MUSICAL INSTRUMENTS WITH USER SELECTABLE AND CONTROLLABLE MAPPING OF POSITION INPUT TO SOUND OUTPUT

BACKGROUND OF THE INVENTION

1. Field of the Invention

The present invention relates, in general, to computer music synthesis and virtual musical instruments, and more particularly to a virtual musical instrument system and method for mapping positional data received from a user or gestural interface into a sound output based on a musical approach selected by a user via a graphical user interface.

2. Relevant Background

Electronic music instruments have been available for many years that are capable of generating a wide variety of electronic and computer synthesized sounds. More recently, virtual musical instruments (VMIs) have been developed that use a sound synthesis system to create a sound output in response to the sensing of a position of a transmitter (such as a light baton). These virtual musical instruments generally utilize a musical instrument digital interface (MIDI) and MIDI controllers in an attempt to translate computer data into music and vice versa. While representing many technical advances, these virtual musical instruments have not been widely accepted by musicians or by general consumers due to a number of limitations.

One limitation of currently available MIDI controller devices (which are sometimes inappropriately labeled as virtual musical instruments) and virtual musical instruments is poor ergonomic design. Typically, MIDI devices have been created to imitate traditional physical music instruments and have similar gestural interfaces (e.g., the interaction between a performer or user and an instrument or receiver). These devices are not true virtual musical instruments because they do not allow for a user performance in air without physical contact(s) with sensors or sensor surfaces. For example, a MIDI keyboard and a MIDI guitar will require a user to replicate the fine muscle movements employed with a traditional piano and guitar moving or operating strings and keys. Similarly, a percussion controller in a MIDI device will generally require a drumstick or baton to strike a sensor surface imitating traditional percussion gestures. Unfortunately, up to fifty percent of all professional musicians suffer muscle-related injuries due to the repetitive fine muscle motions required by traditional physical musical instruments. These same injuries will most likely occur with extended use of existing MIDI devices. Further, most MIDI devices and virtual musical instruments have a fixed gestural interface with a limited input area(s) such that each user is forced to modify their movements to comply with the provided interface, which may increase ergonomic problems and otherwise limit the musical usefulness of the instrument.

In addition to ergonomic limitations, many musicians are dissatisfied with the musical usefulness of virtual musical instruments. In many cases, the virtual musical instrument is created by technicians without attention to the benefit of capturing a musician's expressive capability in the created music or sounds. Many presently available virtual instruments are complicated to operate and install and are expensive to purchase, which further reduces their attractiveness to consumers.

Hence, there remains a need for a virtual musical instrument with enhanced ergonomic characteristics that limit repetitive motion injuries and with improved mapping of transmitter or controller position to sound output to provide enhanced musical usefulness. Preferably, such a virtual musical instrument would be readily controllable and adjustable by a user, inexpensive to purchase and maintain, and require minimal training and practice to operate, e.g., be predictable and intuitive in operation.

SUMMARY OF THE INVENTION

The present invention addresses the above discussed and additional problems by providing a virtual musical instrument (VMI) system that enables a user to use a single arrangement of positional data receivers and controllers and synthesizers and output devices to create a wide range of output music and sounds simply by selecting and customizing mapping routines through a graphical user interface. The VMI system of the invention allows a user to map user positional data to a variety of outputs by first selecting a mapping routine from a set of available mapping routines (e.g., set of musical approaches) and second customizing the selected mapping routine.

Significantly, the VMI system utilizes software or computer programs located in a user friendly user system to create a range of data outputs to create virtual instruments based on positional data (which may be provided by a wide range of hardware arrangements). In this manner, the user can readily and simply customize a single hardware arrangement to create a large number of virtual musical instruments and modify each of these created instruments to suit their ergonomic and other needs. The mapping or control software (e.g., mapping routines) is uniquely adapted to accept and is able to read MIDI files (i.e., computer files containing music), which previously was not available in virtual musical instruments. Preferably, the VMI system of the invention provides a relatively standardized method of accepting musical data for conducting and other musical approaches. In this manner, the user via the user system and included mapping routines can trigger and control MIDI files in a user friendly, non-cryptic fashion to create a musically useful output.

More particularly, a method is provided for mapping user positional data to output data based on user selection and customization input. The method includes displaying a number of mapping routine identifiers (such as icons or buttons or lists) to a user through a user interface. User selection input is then received indicating a user selection of one of the mapping routine identifiers and a mapping routine corresponding to the selected identifier is retrieved and executed. In some embodiments, such as a conductor embodiment, the user can select a MIDI file to conduct. User position data is received (e.g., MIDI data from a MIDI hardware controller). The method further includes processing the user position data with the selected mapping routine to map the user position data to output data. The output data may then be transmitted via an interface such as a MIDI interface to an output device to create an output (such as a synthesizer connected to speakers and the like).

A virtual musical instrument method is provided for mapping positional data from a hardware controller to output data useful by an output device in creating an output (e.g., musical notes, sounds, and special effects). The method includes loading and executing a mapping routine and then requesting user input for customization of output parameters used by the mapping routine in mapping positional data. The requested user input is received and then the mapping routine is customized based on the user input. Significantly, this customization feature enables the method to be adapted to suit the ergonomic needs or goals of the operator (e.g., configure for a wide range of motions or a very narrow range of motions as positional inputs). The output parameters are typically displayed to the user via a user friendly graphical user interface where the user can readily select parameters to modify and enter or select new parameters to readily adapt or customize the selected mapping routine. The method continues with receiving positional data including transmitter coordinates from the hardware controller and then mapping the received position data to output data.

In one embodiment, the output data includes MIDI data and customized output parameters include a gestural or performance area range to affect a desired size or shape for inputting signals to the hardware controller.

In other embodiments, the output parameters include MIDI files (e.g., which song to conduct or map), MIDI note numbers, MIDI program numbers, MIDI velocity numbers, MIDI channel information, MIDI controller data, and MIDI pitch bend information. The method continues with transmitting an output signal including at least a portion of the output data to the output device (e.g., a synthesizer or synthesizer chip connected to a speaker(s)).

DETAILED DESCRIPTION OF THE PREFERRED EMBODIMENTS

Figure 1:
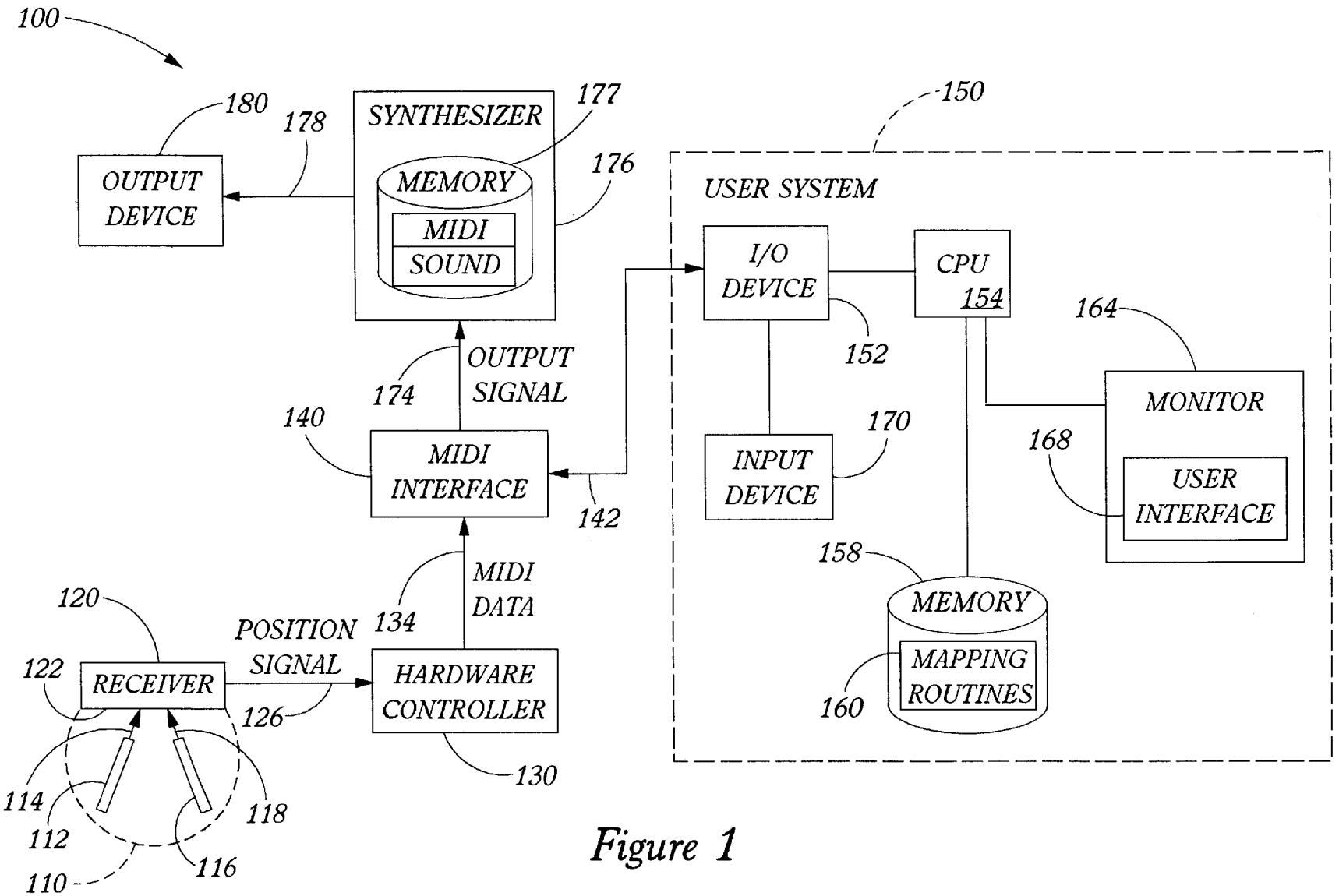
FIG. 1 is a functional block diagram of a virtual music instrument (VMI) system according to the present invention.

A virtual music instrument (VMI) system 100 according to the present invention is illustrated in FIG. 1. The VMI system 100 will be described in detail for use in mapping position data from a performance area in a gestural interface to MIDI or sound files. The VMI system 100 is adapted to allow a user to select from a number of mapping routines (e.g., musical approaches) and then to process or map the position and other input data based on the selected routine to create output data or signals that are utilized to create music with MIDI files or sounds or special effects with sound files. While the description will emphasize the application of the VMI system 100 in a musical performance environment, the VMI system 100 includes features that are readily applicable to other environments, such as virtual reality games, in which mapping of gestures to a video or audio output are useful. These other applications and modifications of the VMI system 100 will be apparent to those skilled in the art and are considered within the scope of the following description and the breadth of the following claims.

As illustrated, the VMI system 100 generally includes a gestural interface 110 for inputting and receiving user positional data a receiver 120, hardware controller 130, and MIDI interface 140 for processing the positional data into MIDI data, a user system 150 for receiving the MIDI data and mapping the MIDI data with a user selectable and configurable mapping routine 160 to a desired output, and a synthesizer 176 and output device 180 for generating an output based on the output signal from the user system 150. As will become clear, the VMI system 100 allows a user to quickly and easily select a technique for use in mapping positional data to create a range of outputs and to establish a gestural interface 110 that better suits their ergonomic needs.

The VMI system 100 is preferably adapted to enable a user to provide performance or gesture input in a manner that reduces repetitive motion injuries and provides a user with a relatively wide range of motions.

In this regard, a wide range of input devices may be used to track the position of a user's hands or feet or to identify movements of the user's body. In one embodiment, a gestural interface 110 (i.e., an area in which a user can move and have their movements and position detected) is provided in which a first or left transmitter 112 is used to transmit an input signal 114 to a performance area 122 of a receiver 120 and a second or right transmitter 116 is used to transmit an input signal 118 to the performance area 122.

The transmitters 112, 116 may take a number of forms, such as devices that strap or attach to portions of a user's body and transmit electromagnetic or other transmissions. In a preferred embodiment, the transmitters 112, 116 are hand-held transmitters or wands that transmit an light beam (e.g., an infrared beam and the like) as a signal 114, 118. Further, the transmitters 112, 116 may be battery operated to provide further freedom of movement and include a marking or indication useful in differentiating between the first and second transmitters 112, 116. This differentiation is important as the input signals 114, 118 are processed or mapped differently to better simulate certain instruments and provide user control over output parameters (such as volume, note pitch, and the like).

The receiver 120 has a receiving surface or performance space 122 including one or more photodectors or other optical receivers adapted for receiving the input signals 114, 118 to sense (e.g., determine based on triangulation) a horizontal and vertical position of each transmitter 112, 116 (e.g., the position of the user's hand). The size of the gestural interface 110 and performance area 122 will vary depending upon the receiver 120 (e.g., the photodectors and receiving devices used) and on the type of transmitters 112, 116. In some embodiments, the performance area 122 (or at least the detection area) may be 10 feet in width by about 5 feet in height or larger. In other words, the detection range of the receiver 120 may comprise a specific vertical range (such as 3 to 5 feet) and a specific horizontal range (such as 7 to 10 feet) that will vary with the hardware components utilized and the VMI system 100 is adaptable to function well with numerous performance area 122 sizes and shapes.

The receiver 120 transmits the positional data (e.g., vertical and horizontal coordinates) over connection line 126 to a hardware controller 130 that preferably includes processing capacity for converting raw positional data into MIDI and other positional data. During operation, a user moves transmitters 112, 116 that operate to transmit input signals 114, 118 which are received and initially processed by the receiver 120 via performance area 122. The receiver 120 then transmits position signals corresponding to the input signals 114, 118 to the hardware controller 130. The hardware controller 130 utilizes a processor, such as a digital signal processor, to process the position signals into useful positional data and other MIDI data useful in mapping the position and movement of the transmitters 112, 116 to a musical, sound, video, or other output. The MIDI data may include the horizontal and vertical coordinates of each transmitter 112, 116 and other information such as velocity, acceleration, and the like. The hardware controller 130 then transmits the processed positioning data as MIDI data to a MIDI interface 140.

As will be understood, numerous controller devices may be used for hardware controller 130 to provide the functions of processing positional data and outputting MIDI data. For example, the hardware controller 130 may comprise many well-known virtual controllers, muscle controllers, keyboard controllers, and percussion controllers. The use of muscle controllers is useful for operators or users having disabilities that restrict their range movements. As will become clear, the VMI system 100 is configured to enable a user to quickly and easily vary key parameters such as amount of movement necessary to conduct or play an instrument.

In one preferred embodiment, the controller 130 (and receiver 120 and transmitters 112, 116) are distributed by Buchla and Associates as the "Lightning II" MIDI controller. As will become clear from the following discussion, the specific controller utilized is not significant to the invention as long as the MIDI interface 140 receives positioning data, which the VMI system 100 efficiently maps to a desired output. Preferably, the coordinate information included in the MIDI data transmitted to the MIDI interface 140 is differentiated for each transmitter and for the horizontal and vertical axis. For example, the horizontal and vertical coordinates may range from 0 to 127 (or some other upper limit) and a horizontal and a vertical coordinate number would be provided for each transmitter 112, 116.

The MIDI interface 140 is provided to receive the MIDI or positional data from the hardware controller 130 and to pass this data in a useful form to an input/output device 152 (such as a serial port) of the user system 150. Again, the specific implementation of the MIDI interface 140 is not limiting to the invention and should be selected to suit the user system 150 and may be located external to the user system 150 or be incorporated within the user system 150. For example, the user system 150 may comprise a standard personal computer or any other useful electronic processing device with a serial or parallel port. In this case, the MIDI interface 150 may be used to connect the hardware controller 130 to the user system 150 and comprise a serial, parallel port MIDI interface. In other embodiments, the MIDI interface 140 may comprise a joystick/gameport MIDI interface, an internal MIDI interface, or a USB port MIDI interface.

As illustrated, the user interface 150 is a computer system or electronic device that includes an I/O device 152 (such as serial, parallel, and USB ports), a central processing unit (CPU) 154 for performing logic, computational, and decision-making functions, an input device 170 such as a mouse, a keyboard, a touch screen, and audio input for allowing a user to input data, a monitor 164 for displaying information to a user via a user interface 168, and memory 158. During operation, the CPU 154 functions to display a user interface 168 (such as a graphical user interface) on the monitor 164 through which a user can provide input.

Specifically, the graphical user interface 168, which may include pull down lists, buttons, and the like for presenting information to the user, is adapted to display at least a listing of the mapping routines 160 from which the user can select to direct the CPU 154 to process the received MIDI data. The user may operate the input device 170 to make a selection via the graphical user interface 168. The CPU 154 then downloads and/or executes the selected mapping routine 160 and processes incoming MIDI data from the hardware controller 130 based utilizing the particular mapping routine 160. Preferably, the user may also provide configuration input after the mapping routine 160 is selected (such as by selecting a particular motion range at the gestural interface 110, by selecting a particular MIDI file to map to output, and by selecting or altering other mapping parameters, which is discussed in more detail with reference to FIG. 2).

In one embodiment, the mapping routines 160 are a set of musical approaches or routines that a user can select to map the gestural input signals 114, 118 to output data or signals transmitted from the user system over line 174 to a synthesizer 176. For example, the mapping routines may indicate a single or multiple instruments and the outputs may be notes that would be produced by such instruments. Alternatively, the mapping routine may be a conductor routine, and the mapping may include responding to the certain gestures or movements of the transmitters 112, 116 by playing a next note in a MIDI file and/or by altering a MIDI file parameter (such as tempo, volume, pitch, and the like).

The synthesizer 176 then retrieves from memory 177 an appropriate MIDI file or sound file and uses the received output signal to instruct the output device 180 via line 178 to create an output (such as a note in a MIDI file or a sound from a sound file). The synthesizer is shown to be separate from the user system 150 but may also be included within the user system 150, such as a synthesizer card or chip. The output device 180 may be any useful device for creating a desired output, such as one or more speakers or lights or video screens for visual outputs.

Figure 2:
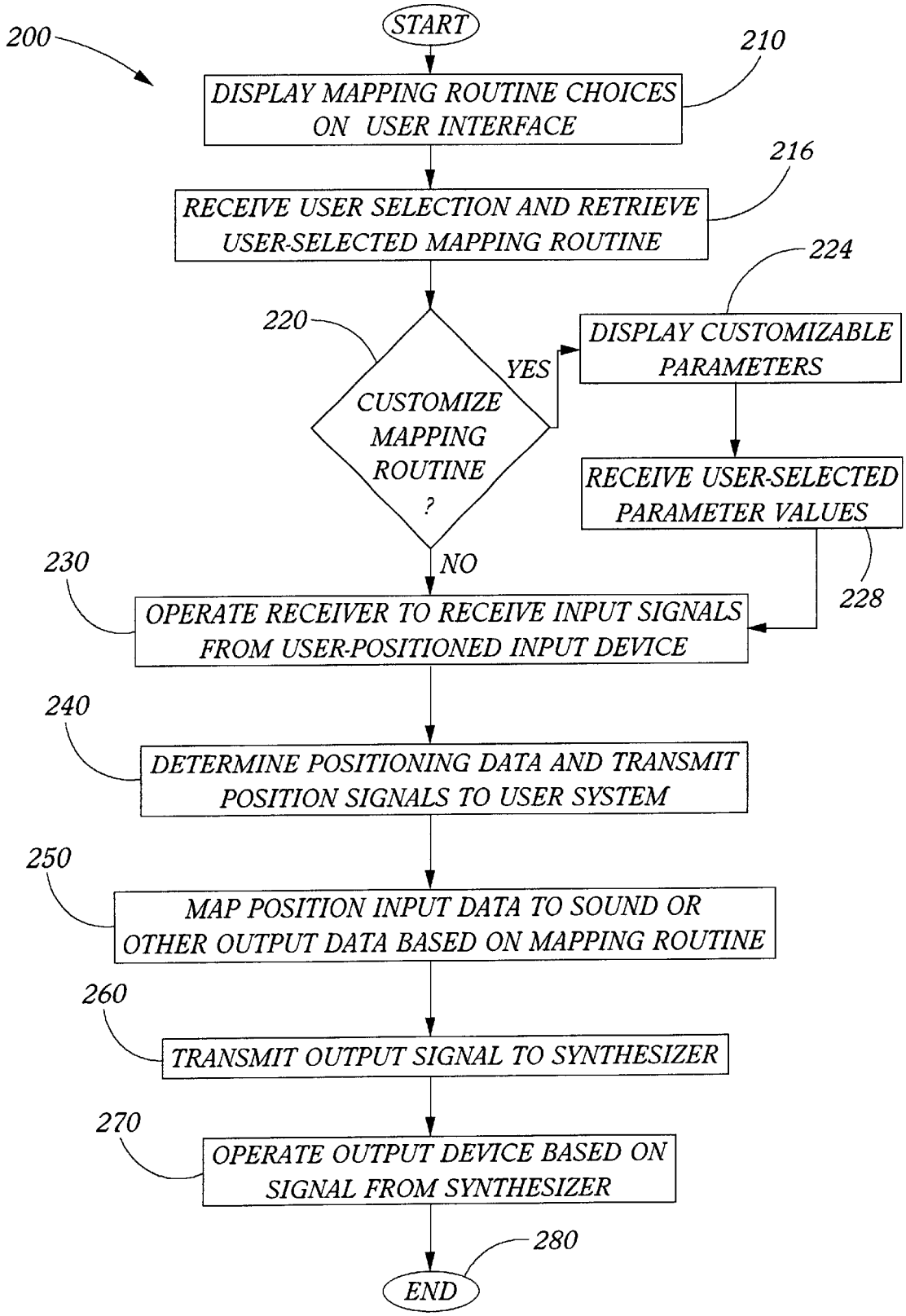
FIG. 2 is a flow chart illustrating exemplary functions performed by the VMI system of FIG. 1 to effectively map input data from a gestural interface to user selectable sounds and/or MIDI programs.

With this general overview of some of the hardware and other components of the VMI system 100 understood, it may now be helpful in understanding the invention to discuss fully how the user system 150 acts to allow a user to select and configure mapping routines and then uses that selected and configured mapping routine to map position information to an output. Referring to FIG. 2, a mapping process carried out by the VMI system 100 is illustrated. The mapping process 200 begins at 210 with the CPU 154 operating to display a listing of the mapping routines 160 in a user interface 168 on the monitor 164. At 216, the user operates the input device 170 to select one of the mapping routines 160 for use in mapping any received MIDI data. In this manner, the VMI system 100 can be utilized by a user to create a wide range of outputs based on the same or different gesture inputs. For example, the mapping routines 160 may include a plurality of musical approaches such as one instrument, two instruments, four instruments, conductor, conductor with sample trigger, a blues organ, a range of motion blues organ, a microtonal instrument (such as a harp) talking drums, or other instruments, instrument combinations, and special effects. In this case, the user selects one of these musical approaches at the user interface 168 and the CPU 154 retrieves the selected mapping routine from memory 158 and runs any associated software routines and commands.

At 220, for many mapping routines 160, the user is allowed to customize the selected mapping routine 160 such as by setting certain mapping or output parameters and/or by selecting a MIDI, sound, or other output file to use in mapping the input position data. Hence, at 220, the CPU 154 determines if the selected mapping routine 160 is a customizable routine. If so, at 224, the CPU 154 operates to display the customizable output parameters on the user interface 164. The user inputs via the input device parameter values to select or modifies the displayed parameters and/or accepts defaults at 228. For example, if the user selected the conductor musical approach, the CPU 154 operates to display a listing of available MIDI files stored in memory 176 that can be conducted or mapped. In other words, the VMI system 100 is adapted such that the mapping routines 160 will accept MIDI files as input (in this case to conduct), which is a significant improvement and variation over prior art devices.

In one preferred embodiment, the user is able to customize the detection range of the receiver 120 such as by modifying how input signals 114, 118 are received and/or processed at the performance area. For example, to provide a desired ergonomic design, the performance area 122 may be customized to be 10 feet by 5 feet (e.g., the maximum detection area of the receiver) or alternatively to be 2 feet by 1 feet (a reduced detection area to reduce the range of motion required to achieve a desired output). In this manner, the VMI system 100 provides a mapping process 200 that is both user selectable and user configurable. Addressing ergonomic issues of virtual musical instruments is another important feature of the inventive VMI system 100 that was previously largely ignored or ineffectively addressed.

At 230, the mapping process 200 continues with the receiver 120 operating to receive or detect input signals 114, 118 from the transmitters 112, 116. At this point, the user is moving the transmitters 112, 116 in and out of the performance area 122 or repositioning (or gesturing with) the transmitters 112, 116 in the gestural interface 110 to create a desired output.

At 240, the process 200 continues with determining position data and transmitting position signals to the user system 150. As shown in FIG. 1, the receiver 120 operates to receive the input signals 114, 118, which are processed into a position signal and transmitted to the hardware controller 130. The hardware controller 130 then processes the raw positional data into useful MIDI data that is transferred via the MIDI interface 140 to the user system 150 for further processing. Additionally, the controller 130 may transmit the MIDI data on different channels. For example, the controller 130 may transmit position values ranging from 0 to 127 indicating the horizontal position (from left to right on the performance area 122) of the first transmitter 112 on a first communication channel, position values ranging from 0 to 127 indicating the vertical position (from low to high in the performance space 122) of the first transmitter 112 on a second communication channel, position values ranging from 0 to 127 indicating the horizontal position (from left to right in the performance space 122) of the second transmitter 116 on a third communication channel, and position values ranging from 0 to 127 indicating the vertical position (from low to high in the performance space 122) of the second transmitter 116 on a fourth channel.

Figure 3:
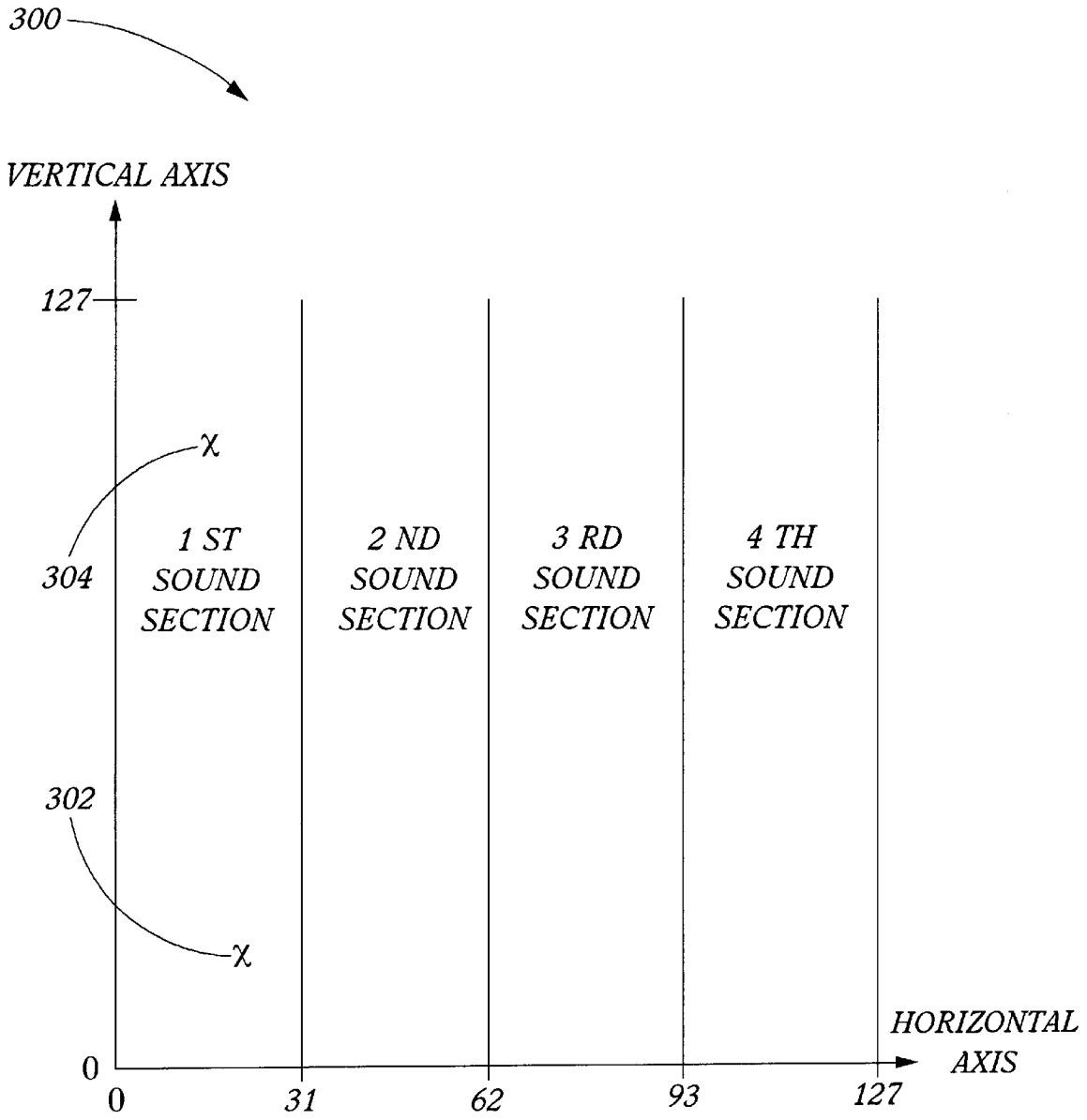
FIG. 3 is a graphical representation of one simplified method used by the VMI system of FIG. 1 in mapping input from a first and a second transmitter to a sound and other parameter (such as volume).

At 250, the user system 150 uses the selected and customized mapping routine to map the received MIDI data or position data to output data. If appropriate based on the mapping of 250, an output signal is transmitted by the user system 150 to the synthesizer 176. For example, the mapping routine 160 will provide or trigger an output signal to be sent if the received positional data for one or both of the transmitters 112, 116 is within a sound zone, e.g., in a coordinate range included in the mapping routine 160 to map a gesture or user position to a sound or note. For example, FIG. 3 provides a graphical representation 300 of such mapping that might be performed in one embodiment of a four-instrument or four-sound mapping routine.

In this illustration, the performance area 122 has been divided equally into four sound sections (i.e., $1^{st}$, $2^{nd}$, $3^{rd}$, and $4^{th}$ sound sections) which each represent a different instrument or sound such as loops, chimes, arpegiator, cartoon effects, environment sounds, analog sounds, church bells, or numerous other instruments and sounds. Either or both the first and second transmitters 112, 116 may be used to create or trigger a sound by positioning the transmitter 112, 116 within one of the sound sections (or passing the transmitter 112, 116 through the section) . The vertical coordinate may be used to map another output parameter such as volume of the sound. For example, the mapping routine may be configured such that the first transmitter 112 position is used to select the instrument or sound and the second transmitter 116 position is used to provide secondary output parameters. As shown, coordinate 302 indicates the position of the first transmitter 112 and the mapping routine acts to create an output signal that maps the input position data to a the first sound section. The output signal also includes the mapping of coordinate 304 of the second transmitter 116 position to a second parameter such as higher volume. The use of a plurality of mapping routines 160 allows the VMI system 100 to be quickly modified and operated to produce a wide variety of sounds and outputs.

The synthesizer 176 responds at 270 to operate the output device 180 to create a note, sound, or other effect using the output signal and a MIDI or sound file from memory 177. The mapping process 200 is ended at 280 at which point additional input signals may be received at 230 using the same selected and customized mapping routine or the user may select a different mapping routine at steps 210 and 216.

With the more general mapping process 200 understood, it may now be useful to describe a number of specific mapping processes that are performed by the VMI system 100 when a user selects at 216 a specific mapping routine 160. These mapping routines 160 are musical approaches or mapping techniques (e.g., nine musical designs) that are illustrative of the unique features of the invention but are not meant as a limitation as these features are also applicable to other virtual reality implementations (such as virtual reality video games in which motion and position inputs taken from a gestural interface are mapped to audio and video outputs).

In a first "one instrument" mapping routine 160, the user system 150 operates to receive the position information, map the information, and create an output signal to the synthesizer to imitate a single instrument (which can be selected at the customization step 228 of process 200). In practice, when the user crosses the first or second transmitter 112, 116 over any portion of the performance area 122, the mapping routine 160 processes the received MIDI data to map the input to trigger a sound by issuing an output signal to the synthesizer. The output signal over line 174 may contain a variety of information to create a sound via output device 180. For example, the output data in the signal may include program change information, a MIDI note number (or note on command), a velocity number or information, and a channel number or indicator (and/or other MIDI information useful by the synthesizer 176 to imitate the selected instrument).

In the customization step 228 or at another time via the user interface 168, the user can readily change this output data (e.g., change the program change, note number, velocity number, and channel number data) to create a new mapping routine to map the incoming signal to a different sound. This change may be affected by the CPU 154 by taking the user input for a customization or change and making another "makenote" routine or object active that maps input to differing output data. In this manner, when positional data indicates a transmitter has passed through the performance area the mapping routine passes a trigger or activator to the new or current makenote or sound creator routine or object.

In a "two instruments" mapping routine, the user system 150 acts to map positional data in a manner that allows a user to "play" two different instruments (such as two of the following instruments: a bass drum, a snare drum, a timpani, toms, and timbale). The mapping routine 160 is configured to divide the performance area 122 for each transmitter 112, 116 into two sound sections (such as two equal horizontal sections of 0 to 63 and 64 to 127 as shown in FIG. 3). When horizontal MIDI data received by the user interface is between 0 and 63, the mapping program 160 functions to send an output signal to the synthesizer 176 (again including program change, note number, velocity number and channel number data). When horizontal MIDI data received is between 64 and 127, the mapping routine sends an output signal to the synthesizer with different MIDI data (such as different program change, note number, velocity number, and/or channel number data). Again, the output data signal is created by a makenote subroutine or object which is triggered by the mapping routine 160 when the horizontal input data is within one of the programmed or predefined sound zones or sections of the performance area 122. Again, the user can customize the mapping routine 160 to alter the program change, note number, velocity number, channel number, or other MIDI data (i.e., the output parameters used by the mapping routine in creating a unique mapping result) via the user interface 168 to map the incoming position data to a different sound.

In a "four instruments" mapping routine, the performance area 122 for each transmitter 112, 116 is divided equally into four sound sections (e.g., two vertical and two horizontal sections or four horizontal sound sections (0 to 31, 32 to 62, 63 to 93, and 94 to 127) with each section representing a different instrument (such as loops, chimes, arpegiator, cartoon effects, environment sounds, analog sounds, church bells, and the like). When a transmitter 112, 116 is detected to cross into one of the four sections, a sound is triggered. When the transmitter 112, 116 crosses into one of the other sections, a different sound is triggered and so on. The user can customize the mapping routine to move the sections, change the size of the sections, change the size of the performance area, change which instrument is mapped for each section, and other mapping changes. The output signal again is typically created by the optionally customized (or selected to suit the customization) makenote routine or object and includes MIDI data that maps the received position data or MIDI data to a sound created by the synthesizer 176 (e.g., program change, note number, velocity number, and channel number data).

In a "conductor" mapping routine, the user is allowed to customize the mapping routine 160 by selecting a MIDI file to conduct or control by setting tempo, volume, and other output parameters mapped by positioning the transmitters 112, 116. Significantly, the mapping routine 160 is adapted to accept a range of MIDI files as input. In one embodiment, the tempo is determined by the mapping routine 160 by determining the delta time between two "baton taps" (e.g., crossing of the transmitter 112, 116 in the performance area 122). The MIDI initially begins playing on the second tap and the tempo may be adjusted throughout the playing of the MIDI file in this fashion. The other of the transmitters 112, 116 may be used to control volume and/or other output parameters (such as by vertical positioning). Here, the output signal is created by one or two objects or routines (such as a "next" object and/or a "volume" object) that are triggered when one transmitter 112, 116 crosses the performance area 122 and when the other transmitter 112, 116 is positioned in the performance area 122.

In a "conductor with sample trigger" mapping routine, the mapping process 200 is similar with the user controlling tempo with a first transmitter 112, 116 but instead of controlling volume a second transmitter 112, 116 is used to trigger a sound effect. For example, if the user selects a MIDI file that plays "Take Me Out to the Ballgame", the sound effect may be the crack of a bat which is triggered by the positioning of the second transmitter 112, 116.

In a "blues organ" mapping routine, the horizontal performance space of one transmitter 112, 116 is divided into seven equal zones. When the transmitter 112, 116 passes through each zone an output signal is sent to the synthesizer 176 with predefined MIDI data (such as a note number, velocity data, a channel number, and a program number) corresponding to the particular zone. The other transmitter 112, 116 may be utilized to input other output parameters such as volume.

In a "range of motion blues organ" mapping routine, the mapping process 200 is similar to the blues organ process but the mapping routine 160 is customizable to allow a user to set the range of motion (i.e., the size of the performance area 122 or its corresponding detection range). For example, the user may be shown at step 224 of process 200 two, three, or more ranges of motion. In one embodiment, three custom ranges are provided including small range of motion, medium range of motion, and wide range of motion which may correspond to 0 to 5 feet in width, 5 to 10 feet in width, and 10 to 15 feet in width. In this manner, the mapping routine is customizable to suit a user's ergonomic needs, the space available for gestural interface 110, and the like.

In a "microtonal instrument" mapping routine, the performance space 122 is divided into a number of sound sections equal to a predetermined number of notes. For example, the number of sound sections would equal the number of notes playable by the instrument being created (such as 43 notes for a harp). The divisions may be along the vertical or horizontal axis with one transmitter 112, 116 triggering the creation of an output signal (such as a file including a note number) corresponding to that sound section. The second transmitter 112, 116 again can control other output parameters such as volume. The microtonal approach or mapping routine 160 is an important embodiment of the invention because it illustrates how a mapping routine 160 can readily be adapted and provided to efficiently map nearly any size and shape of a performance zone or area 122. The size and shape (two or three dimensional) of the performance area 122 further can be established by the user at steps 220–228 of the mapping process 200 and the mapping customization in these steps can include selection of a range of sounds for mapping to selected portions or points within the performance area 122. The sounds are typically only restrained by the particular microtonal synthesizer 176 utilized to create an output sound. Although nearly any microtonal synthesizer may be selected, the Kyma System available from Symbolic Sound has proven useful within the VMI system 100.

In a "talking drums" mapping routine, a first transmitter 112, 116 is set to provide a sound input so that when it is sensed by the position signal to have crossed the performance area 122 a trigger is created to execute a makenote routine or object. The second transmitter 112, 116 is used to alter another parameter by its positioning within the performance area such as to bend or alter the pitch of the instrument (e.g., drum). The output signal includes MIDI data such as MIDI program number, MIDI note number, MIDI velocity number, MIDI channel information, MIDI controller data, and MIDI pitch bend information.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed. More particularly, FIG. 3 illustrates mapping of positional data in two dimensions based on a horizontal and vertical coordinate system. The VMI system 100 is also useful for mapping three dimensional position data to an output data file or signal. This is readily achieved by the inclusion in the mapping routines 160 of routines configured to accept a third dimension such as depth which allows an operator to move forward and backward in the gestural interface 110 and affect the output data created by the user system 150 and sound produced based on the output signal. Clearly, the VMI system 100 is not limited to a specific receiver 120 and hardware controller 130 but instead includes a number of features that are useful with numerous hardware arrangements and devices that are useful for providing positional data and specifically MIDI positional data.

I claim:

1. A method of mapping user positional data to output data based on user selection and customization input, comprising:

displaying a plurality of mapping routine identifiers to a user through a user interface;

receiving user selection input indicating a user selection of one of the mapping routine identifiers;

executing a mapping routine corresponding to the user selected mapping routine identifier;

receiving user position data from a gestural interface having a performance area with a detection range;

displaying a listing of customizable output parameters for the mapping routine corresponding to the user selected mapping routine identifier and receiving user customization input for at least one of the displayed customizable output parameters, wherein the customizable output parameters include dimensions of the detection range; and processing the user position data with the executing mapping routine to map the user position data to output data, wherein the processing is performed utilizing the customizable output parameters modified by the user customization input.

2. The mapping method of claim 1, wherein the customizable output parameters include a listing of musical instrument digital interface (MIDI) files which can be mapped in the processing.

3. The mapping method of claim 1, wherein the output data includes musical instrument digital interface (MIDI) data and the customizable output parameters include at least one of MIDI note numbers, MIDI program numbers, MIDI velocity numbers, MIDI channel information, MIDI controller data, and MIDI pitch bend information.

4. The mapping method of claim 1, wherein the user position data includes MIDI data including user position coordinates of one or more transmitters relative to a performance area and wherein the processing includes comparing the user position coordinates with a predefined position range in the mapping routine and if determined within the position range, mapping the user coordinate to a predefined output value.

5. The mapping method of claim 1, wherein the output data is configured to be used by a synthesizer and the mapping routine identifiers correspond to a like number of musical approaches, the musical approaches being selected from the group consisting of a one instrument approach, a two instrument approach, a four instrument approach, a conductor approach, a conductor with a sample trigger approach, a blues organ approach, a range of motion blues organ approach, a microtonal instrument approach, and a talking drums approach, wherein each of the musical approaches functions differently in the processing to map the user position to create a unique ones of the output data.

6. A virtual musical instrument method for mapping positional data from a hardware controller to output data useful by an output device in creating an output, comprising:

loading and executing a mapping routine;

requesting user input for customization of output parameters used by the mapping routine;

receiving the requested user input;

customizing the mapping routine based on the received user input;

receiving positional data including transmitter coordinates from the hardware controller, wherein the transmitter coordinates include a first set of coordinates for a first transmitter and a second set of coordinates for a second transmitter;

with the mapping routine, mapping the received positional data to output data including musical instrument digital interface (MIDI), wherein the mapping routine is adapted to perform the mapping to map the first set of coordinates differently than the second set of coordinates; and transmitting an output signal comprising the output data to the output device.

7. The method of claim 6, wherein the customizing includes establishing a size of a gestural range used by a receiver connected to the hardware controller in sensing the positional data.

8. The method of claim 6, wherein the output parameters are selected from the group consisting of mapped MIDI file, MIDI note numbers, MIDI program numbers, MIDI velocity numbers, MIDI channel information, MIDI controller data, and MIDI pitch bend information.

9. The method of claim 6, further including prior to the loading and executing, displaying a plurality of mapping routine identifiers to a user through a user interface and receiving user selection input indicating a user selection of one of the mapping routine identifiers, wherein the loaded and executed mapping routine corresponds to the user selected mapping routine identifier.

10. The method of claim 6, wherein the customizing of the mapping routines affects the mapping routine separately for the first and the second transmitters.

11. A computer-implemented system for mapping user positional information to output data useful for creating an output, comprising:

a memory for storing a plurality of mapping routines;

a user interface for displaying identifiers for each of the mapping routines to a user of the system and for displaying customizable output parameters for the mapping routines;

an input device for receiving user input indicating the selection of one the mapping routine identifiers and receiving user customization input for one of the displayed customizable output parameters; and a digital processor for retrieving one of the mapping routines corresponding to the selected mapping routine identifier, for processing the user positional information based on the retrieved mapping routine and utilizing the customizable output parameters to map the user positional information to output data, and to create an output signal including at least a portion of the output data, wherein the user positional information is collected from a gestural interface having a performance area with a detection range and wherein the customizable output parameters include dimensions of the detection range.

12. The system of claim 11, wherein the output data includes MIDI data and further including an audio synthesizer for receiving and processing the output signal to create the output.

13. A computer readable medium for mapping user position data to output data based on a user selectable and customizable mapping routine comprising:

first computer code devices configured to cause a computer to create a user interface to display a plurality of mapping routine identifiers to a user;

second computer code devices configured to cause a computer to receive user selection input indicating a user selection of one of the mapping routine identifiers;

third computer code devices configured to cause a computer to execute a mapping routine corresponding to the user selected mapping routine identifier;

fourth computer code devices configured to cause a computer to process user position data with the executing mapping routine to map the user position data to output data, wherein the user position data is collected from a gestural interface having a performance area with a detection range; and fifth computer code devices to cause a computer to manipulate the user interface to display a set of customizable output parameters for the executing mapping routine and to receive user customization input for at least one of the customizable output parameters, wherein the customizable output parameters include dimensions of the detection range and wherein the third computer code devices function to execute the mapping routine using the received user customization input.

14. The computer program of claim 13, wherein the user position data includes musical instrument digital interface (MIDI) data and the output data includes MIDI data differing from the MIDI data of the user position data.

15. A method of mapping user positional data to output data based on user selection and customization input, comprising:

displaying a plurality of mapping routine identifiers to a user through a user interface;

receiving user selection input indicating a user selection of one of the mapping routine identifiers;

executing a mapping routine corresponding to the user selected mapping routine identifier;

receiving user position data; and processing the user position data with the executing mapping routine to map the user position data to output data;

wherein the output data is configured to be used by a synthesizer and the mapping routine identifiers correspond to a like number of musical approaches, the musical approaches being selected from the group consisting of a one instrument approach, a two instrument approach, a four instrument approach, a conductor approach, a conductor with a sample trigger approach, a blues organ approach, a range of motion blues organ approach, a microtonal instrument approach, and a talking drums approach and wherein the processing is performed differently for each of the musical approaches to map the user position to create a unique set of the output data.

16. A virtual musical instrument method for mapping positional data from a hardware controller to output data useful by an output device in creating an output, comprising:

loading and executing a mapping routine;

requesting user input for customization of output parameters used by the mapping routine;

receiving the requested user input;

customizing the mapping routine based on the received user input, wherein the customizing includes establishing a size of a gestural range used by a receiver connected to the hardware controller in sensing the positional data;

receiving positional data including transmitter coordinates from the hardware controller;

mapping the received positional data to output data including musical instrument digital interface (MIDI) data; and transmitting an output signal comprising the output data to the output device.

* * * * *